US010988282B2

(12) United States Patent
Vandecasteele

(10) Patent No.: US 10,988,282 B2
(45) Date of Patent: Apr. 27, 2021

(54) CONTAINER

(71) Applicant: DS SMITH DUCAPLAST, Wormhout (FR)

(72) Inventor: Benjamin Vandecasteele, Racquinghem (FR)

(73) Assignee: DS SMITH DUCAPLAST, Wormhout (FR)

( * ) Notice: Subject to any disclaimer, the term of this patent is extended or adjusted under 35 U.S.C. 154(b) by 0 days.

(21) Appl. No.: 16/069,795

(22) PCT Filed: Jan. 13, 2017

(86) PCT No.: PCT/EP2017/050672
§ 371 (c)(1),
(2) Date: Jul. 12, 2018

(87) PCT Pub. No.: WO2017/121853
PCT Pub. Date: Jul. 20, 2017

(65) Prior Publication Data

US 2019/0009947 A1 Jan. 10, 2019

(30) Foreign Application Priority Data

Jan. 13, 2016 (FR) ..... 1650250

(51) Int. Cl.
*B65D 19/18* (2006.01)

(52) U.S. Cl.
CPC .... *B65D 19/18* (2013.01); *B65D 2519/00034* (2013.01); *B65D 2519/00069* (2013.01);
(Continued)

(58) Field of Classification Search
USPC ..... 206/600
See application file for complete search history.

(56) References Cited

FOREIGN PATENT DOCUMENTS

DE 102005008695 A1 * 8/2006 ..... B65D 5/64
DE 202013001983 U1 5/2013
(Continued)

OTHER PUBLICATIONS

International Search Report dated Feb. 23, 2017, issued in corresponding International Application No. PCT/EP2017/050672, filed Jan. 13, 2017, 2 pages.
(Continued)

*Primary Examiner* — Anthony D Stashick
*Assistant Examiner* — L Kmet
(74) *Attorney, Agent, or Firm* — Christensen O'Connor Johnson Kindness PLLC

(57) ABSTRACT

A container includes a base, a folding sleeve and a lid. The sleeve includes several panels configured to be folded and laid out on the base such that the panels extend approximately parallel to the base, and to be unfolded and placed on the base such that the panels extend approximately perpendicular to the base, bearing through lower edges of the panels on the base, the lid being capable of bearing on top edges of the panels when the sleeve is unfolded and placed on the base. The container includes at least one band of flexible material that is fixed to the lid at at least two distant points, and that passes through an orifice in at least one of the panels, the lid configured to be guided by the at least one band when the container is opened, by sliding of the band in the orifice over at least part of the length of the band between said two points.

13 Claims, 8 Drawing Sheets

(52) U.S. Cl.
CPC ..... *B65D 2519/00174* (2013.01); *B65D 2519/00208* (2013.01); *B65D 2519/00268* (2013.01); *B65D 2519/00288* (2013.01); *B65D 2519/00318* (2013.01); *B65D 2519/00338* (2013.01); *B65D 2519/00497* (2013.01); *B65D 2519/00597* (2013.01); *B65D 2519/00641* (2013.01); *B65D 2519/00731* (2013.01); *B65D 2519/00805* (2013.01); *B65D 2519/00915* (2013.01)

(56) References Cited

FOREIGN PATENT DOCUMENTS

| | | | | |
|---|---|---|---|---|
| EP | 2 256 050 | A1 | 12/2010 | |
| EP | 2690027 | A1 | 1/2014 | |
| EP | 2868592 | A1 | 5/2018 | |
| WO | WO-2017063871 | A1 * | 4/2017 | ..... B65D 19/18 |

OTHER PUBLICATIONS

Written Opinion of the International Searching Authority dated Feb. 23, 2017, issued in corresponding International Application No. PCT/EP2017/050672, filed Jan. 13, 2017, 5 pages.

* cited by examiner

Fig. 1
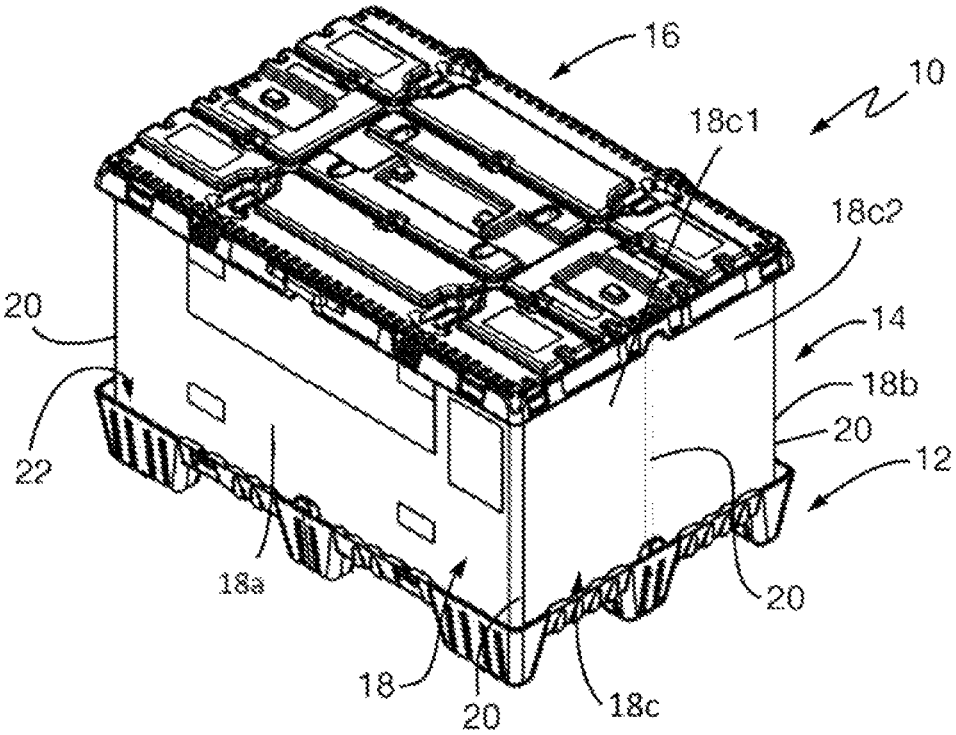
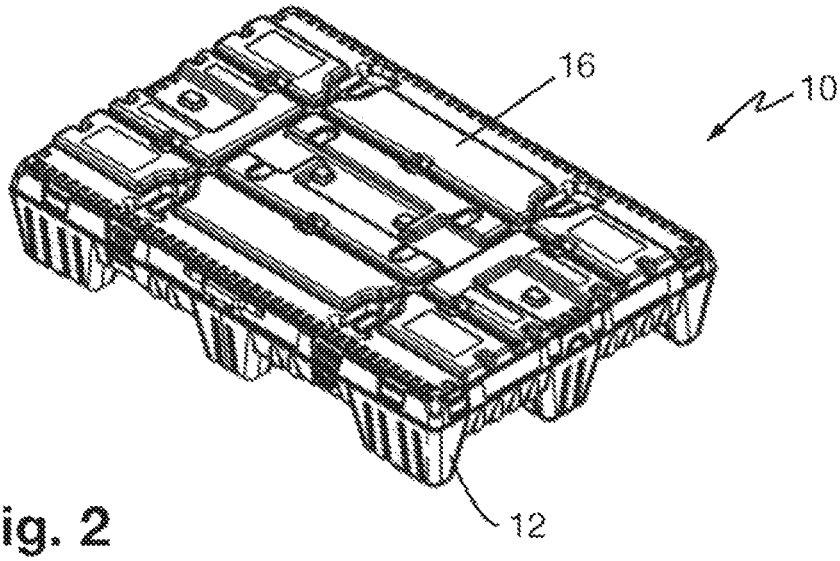
Fig. 2

Fig. 5
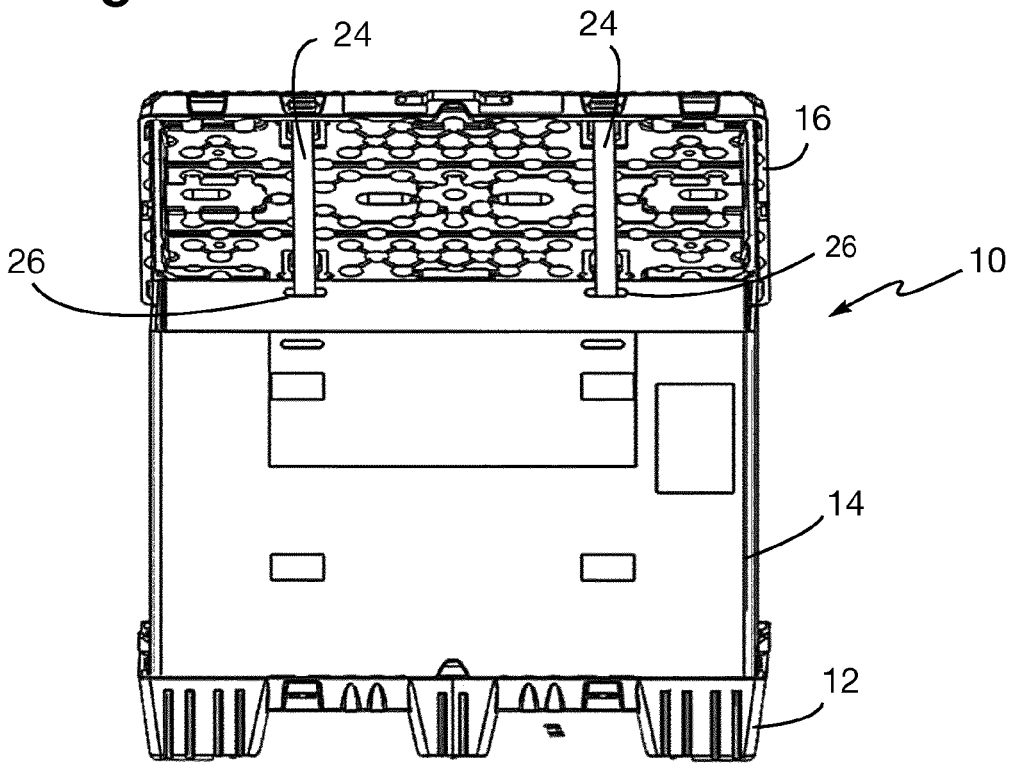
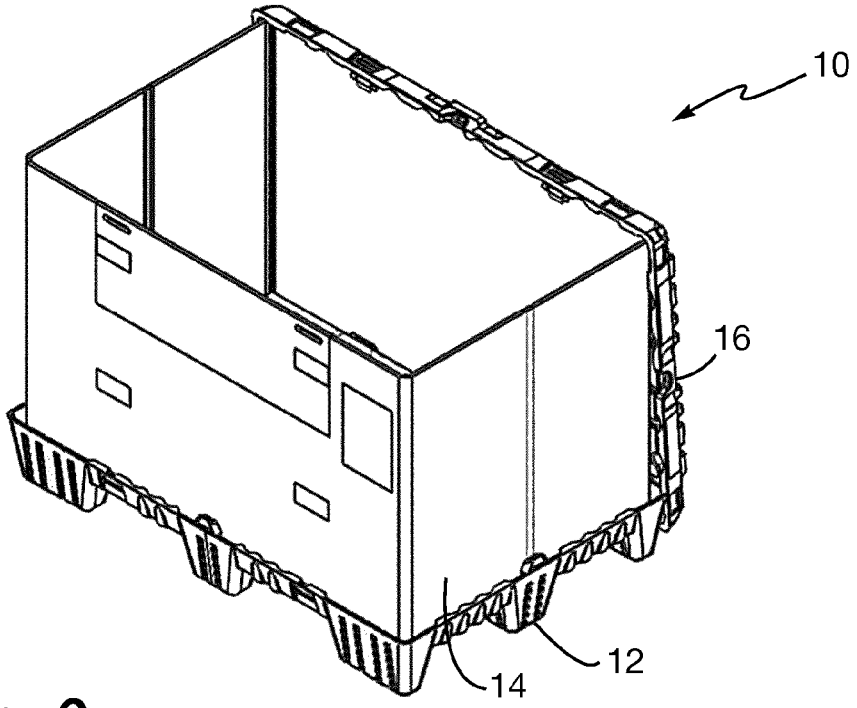
Fig. 6

Fig. 7
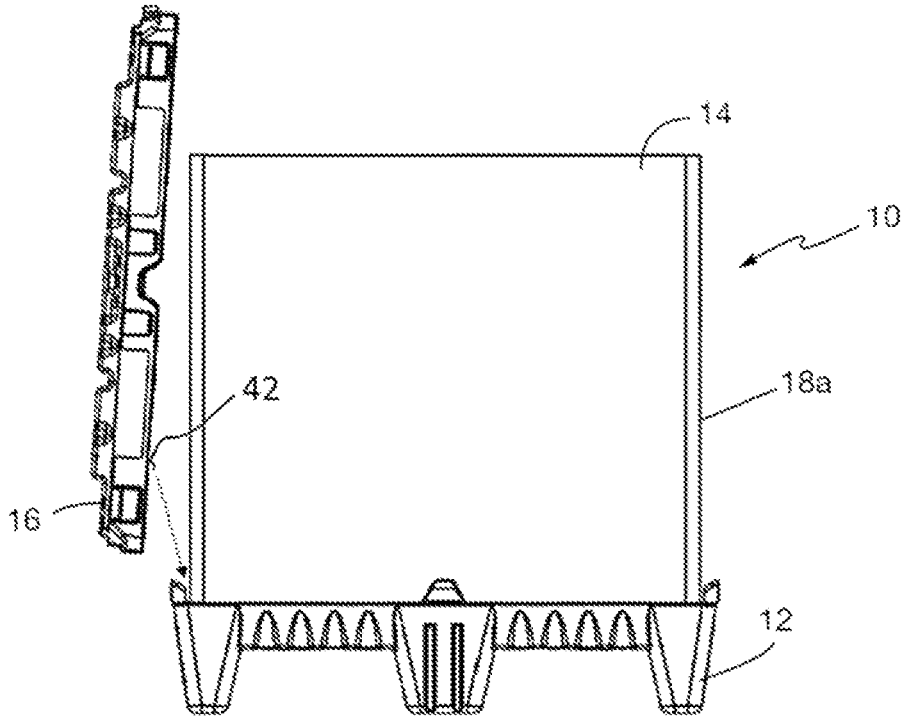
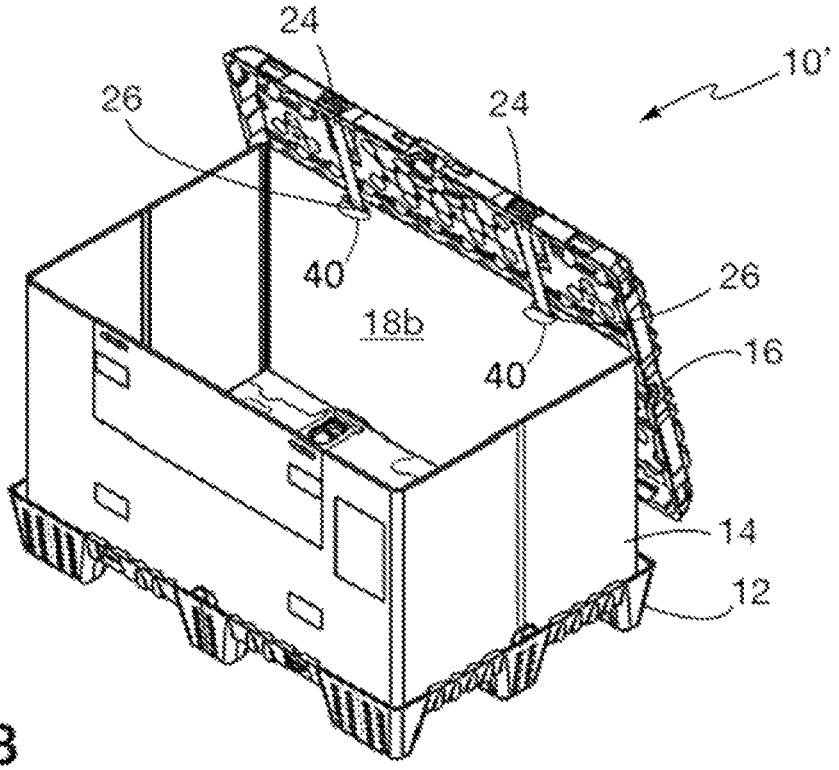
Fig. 8

Fig. 9
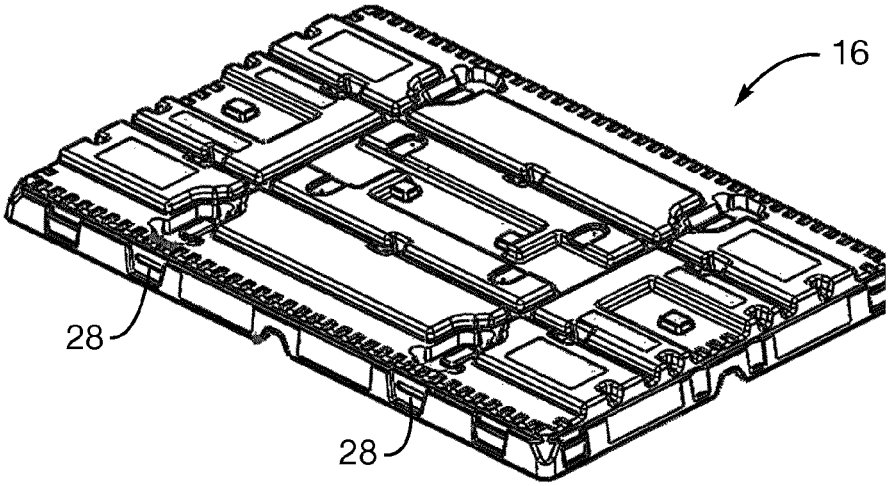
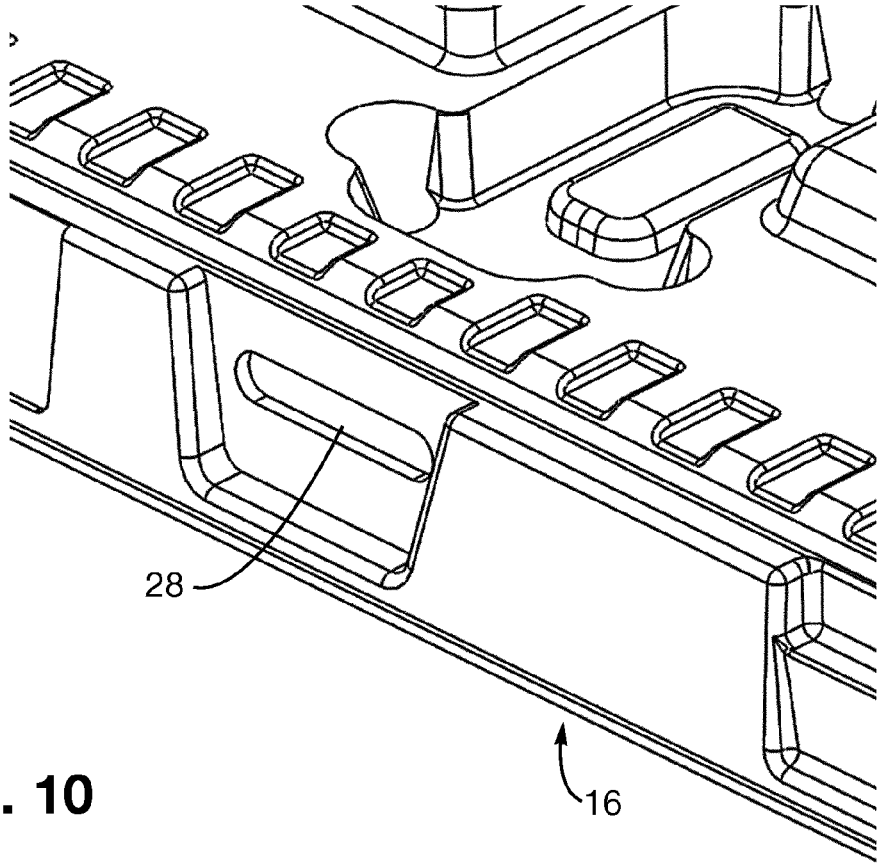
Fig. 10

Fig. 13a
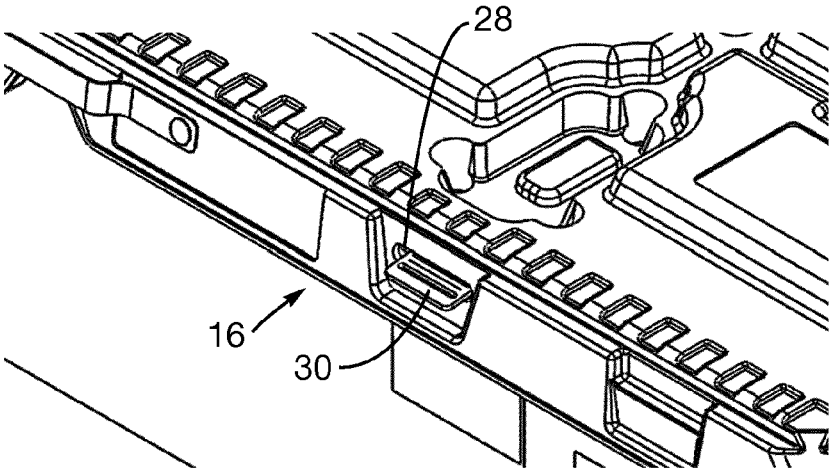
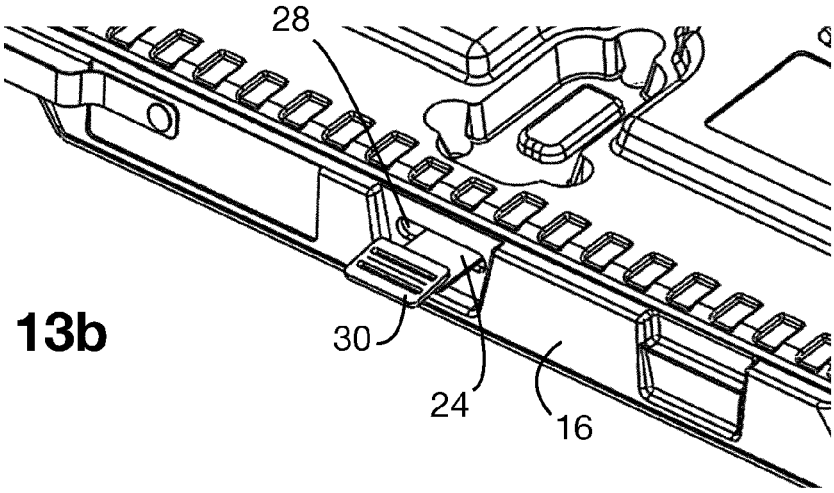
Fig. 13b
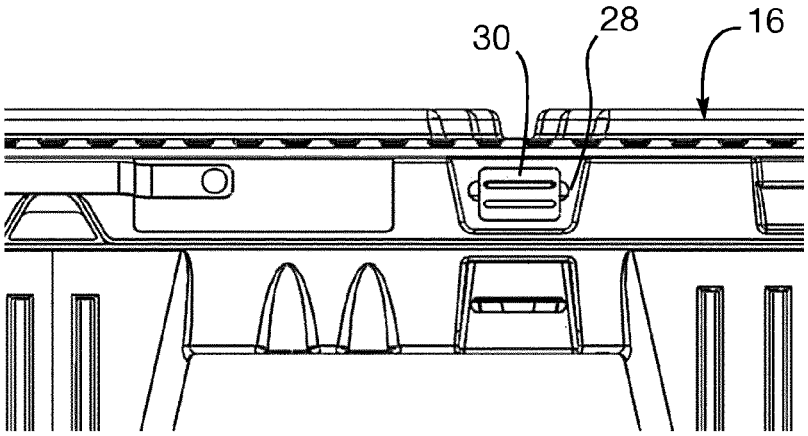
Fig. 13c

CONTAINER

TECHNICAL DOMAIN

This invention relates to a container of the type including a base, a sleeve and a lid.

STATE OF THE ART

The state of the art includes particularly documents EP-A1-2 690 027 and EP-A1-2 868 592.

A container is known comprising a base, a sleeve and a lid, the sleeve comprising several panels and being able to be folded and laid out on the base such that the panels extend approximately parallel to the base, and to be unfolded and placed on the base such that the panels extend approximately perpendicular to the base, bearing on the base through the lower edges of the panels. The lid can be placed on the base when the panels are extended on the base, and is able to bear on top edges of the panels when the panels are mounted vertically on the base.

The Applicant has already proposed that the sleeve can be connected to the base by means of straps, in document EP-A1-2 690 027. This has many advantages. It makes it possible to guide at least some panels when folding or extending the sleeve and therefore to facilitate these steps. It also makes it possible to link the sleeve with the base and avoid using a sleeve that is unsuitable for a base, for example with inappropriate dimensions.

It is also known that the lid can be attached to the sleeve of a container. For example, document EP-A1-2 256 050 describes a complex mechanism with hinges and sliding supports connecting a lid to the sleeve of a container. This technology has disadvantages in addition to its cost resulting from its complexity. This relatively rigid mechanism is located on the top edge of a panel of the sleeve and transmits forces in this zone during repeated displacements of the lid that can weaken and deform the panel.

The state of the art also includes the document DE-U1-202013001983.

Embodiments of the disclosed subject matter provide an improvement to the above-mentioned technologies.

PRESENTATION OF THE DISCLOSED SUBJECT MATTER

The disclosed subject matter is generally directed to a container, comprising a base, a folding sleeve and a lid, said sleeve comprising several panels and being able to be folded and laid out on said base such that the panels extend approximately parallel to said base, and to be unfolded and placed on said base such that the panels extend approximately perpendicular to said base, bearing on said base through lower edges of said panels, said lid being capable of bearing on top edges of said panels when said sleeve is unfolded and placed on the base, the container comprising at least one band of flexible material that is fixed to the lid at least two distant points, and that pass through a orifice in at least one of said panels, said lid being capable of being guided by said at least one band when the container is opened, by sliding of the band in said orifice over at least part of the length of the band between said two points, the band comprising a first longitudinal end fixed to a front edge of the lid or retained relative to this front edge, and a second opposite longitudinal end fixed to a back edge of the lid or retained relative to this back edge, the attachment or retention of said first and second ends of the band is removable.

The invention thus discloses simple and economic means of guiding the lid when it is opened. This means can permanently or temporarily connect the lid to the sleeve, and make a container lid captive to or indissociable from its sleeve.

The panel according to the invention may comprise one or several of the following characteristics taken in isolation or in combination with each other:

- said at least one band is a strap,
- said at least one band is made of fabric, and is preferably elastic,
- the container comprises at least two bands of flexible material,
- said bands are approximately parallel,
- said bands pass through orifices in one and the same panel, such as a back panel of the container,
- the shape of the orifice or of each orifice is elongated in a direction approximately parallel to the plane of the lid or the base,
- the orifice or each orifice is located at a distance from a top edge of the panel in which it is formed,
- the band or each band comprises a first longitudinal end fixed to a front edge of the lid or retained relative to this front edge, and a second opposite longitudinal end fixed to a back edge of the lid or retained relative to this back edge,
- the attachment or retention of at least one of said first and second ends of the or each band is of the removable type,
- the or each band comprises hooking or stop means configured to cooperate with a peripheral edge of said orifice in order to retain said lid in an open rest position, and
- said lid comprises hooking or stop means configured to cooperate with said base in order to retain said lid in an open rest position.

DESCRIPTION OF THE FIGURES

The invention will be better understood and other characteristics and advantages of the invention will become clearer after reading the following description given as a non-limitative example with reference to the appended drawings among which:

FIG. 1 is a schematic perspective view of a container according to the invention, in the expanded position, FIG. 2 is a schematic perspective view of the container in FIG. 1, in the folded or stored position, FIGS. 3 to 5 are other schematic perspective views of the container in FIG. 1 in the expanded position, the container being partially opened by displacement or pivoting of the lid, FIGS. 6 and 7 are other schematic perspective views of the container in FIG. 1 in the expanded position, the container being completely open, FIG. 8 is a view similar to that in FIG. 4 and illustrates a variant embodiment of the invention in which the lid is retained in a rest position, FIG. 9 is a schematic perspective view of the lid of the container in FIG. 1.

FIG. 10 is a larger scale view of part of FIG. 9;

FIGS. 13*a* to 13*c* are other schematic perspective views of bands made of flexible material for the container in FIG. 1, and show steps in the assembly/disassembly of these bands of the lid of the container.

DETAILED DESCRIPTION

Figure 3:
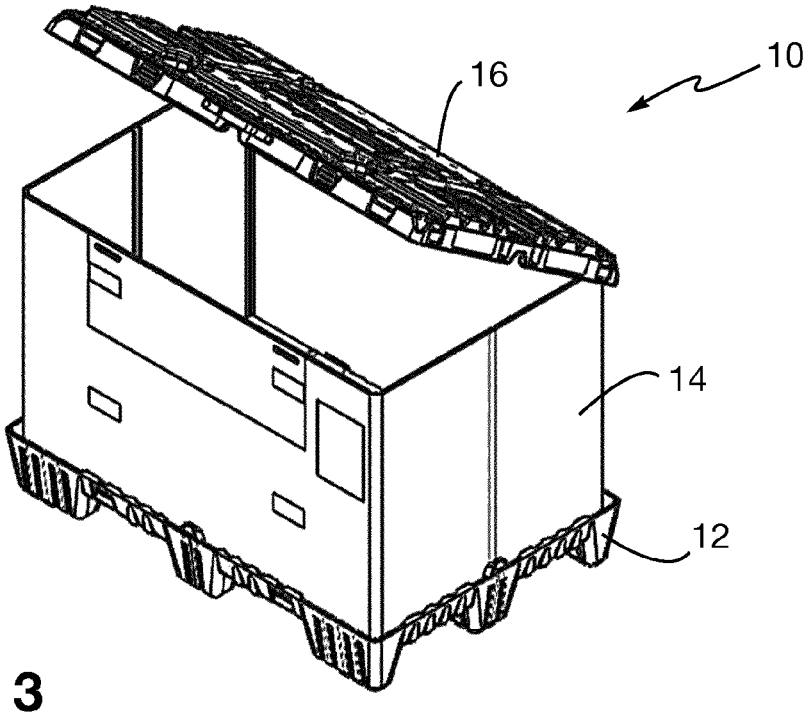

FIGS. 1 to 7 show a first embodiment of a container 10 according to the invention, this container 10 being of the type comprising a base 12, a sleeve 14 and a lid 16.

The base 12 and the lid 16 are preferably each made from a plastic material, for example with a single or double skin. Each is advantageously made in a single piece and can be made by thermoforming.

The sleeve 14 folds up and comprises several panels 18 connected to each other by hinges 20. The sleeve 14 is able to be folded and laid out flat on the base such that the panels extend approximately parallel to the base. The sleeve (in other words the panels) and the base are then approximately horizontal. In this folded position, the lid 16 can be placed on the sleeve or the base, as shown on FIG. 2, to limit the space occupied by the container in this stored position.

The sleeve 14 is also able to be unfolded and placed on the base 12 such that the panels extend approximately perpendicular to the base, bearing on the base through the lower edges of the panels. In this unfolded position, the lower edges of the panels can be engaged in peripheral grooves 22 in the base so that the sleeve can be fixed in this position (FIG. 1). The lid 16 can be placed on the sleeve bearing on the top edges of the panels 18, as shown on FIG. 1. In this position, the top edges of the panels can be engaged in peripheral grooves in the lid.

The sleeve 14 defines a loading or a storage volume. In the example shown, the general shape of the base 12 and the lid 16 is rectangular and the shape of the sleeve 14 in the unfolded position is generally parallelepiped.

In this case, the sleeve 14 comprises four panels 18 including a front panel 18*a*, a back panel 18*b* and two lateral panels 18*c*. Each lateral panel 18*c* is composed of two articulated half-panels 18*c*1, 18*c*2. In the unfolded position shown in FIG. 1, the panels 18*a*, 18*b* are approximately parallel. The half-panels 18*c*1, 18*c*2 of each panel 18*c* are coplanar, and the panels 18*c* are approximately parallel and perpendicular to panels 18*a*, 18*b*.

Although it cannot be seen in the drawings, when in the folded position, the panels 18*a*, 18*b* and the half-panels 18*c*1, 18*c*2 are all approximately parallel, the half-panels 18*c*1, 18*c*2 being inserted between panels 18*a*, 18*b* by folding the hinges 20 along lines approximately vertical or parallel to the panels.

The panels 18 are advantageously made from a single board made of plastic material or in one or several boards welded to each other, appropriately cut and folded. For example, it may be a so-called cellular board obtained by extrusion of plastic material and formed from two plane skin sheets at a spacing from each other and connected by spacers forming cells parallel to each other between the skins. Such a board is marketed under the trade name Akylux®. This material combines lightweight and stiffness along the direction of the cells. It can also be a board marketed under the brand name Akyboard® comprising two sheets at a distance from each other and connected together by spacers in the form of domes, bubbles or cylinders and obtained by extrusion, thermoforming and welding the sheets to each other.

The sleeve 14 is preferably connected to the base 12 by an attachment means similar to that described in document EP-A1-2 690 027. This attachment means comprises one or two straps linked to the base 12, at least two distant points.

The sleeve 14 is arranged to be connected in a sliding connection to the straps through at least one panel 18 such that it can be extended from the stored position flat on the base 12 to the extended position on the base.

The straps are arranged to be parallel to the plane of the base at a short distance therefrom and pass into openings in the sleeve arranged close to the inside edge thereof.

The openings of the straps are preferably formed in the panels 18*a*, 18*b* close to their lower edges. Thus, the straps pass inside the panels 18*a*, 18*b* and underneath the panels 18*c* of the sleeve. The sleeve can slide through their panels 18*c* on the straps and on the base from the upright position to the folded position, as far as a position in which they are folded completely flat in which they can be folded down on the base.

This folding down manoeuvre of the sleeve from the upright position is done by lifting the panel 18*a* containing the strap openings slightly up out of its groove 22, facing the operator, and pushing this panel towards panel 18*b*. The sleeve 14 is folded by its two panels 18*c* raised out of their groove, in translation towards the panel 18*b*, until it is folded flat and upright, at the groove 22 in which this panel 18*b* fits. In this position, with the sleeve 14 being in an unstable position on the base, it can be folded down under its own weight simply by dropping on its side onto the base from the groove 22 in the panel 18*b*.

An inverse unfolding manoeuvre of the sleeve 14 can also be made, lifting the lower edge of the panel 18*b* out of the groove 22 and pulling the panel 18*b* forwards. The sleeve 14 then folds in a translation towards the operator as far as groove 22 close to the operator. When the sleeve 14 is folded flat, it can tip backwards onto the base.

The sleeve 14 is straightened from a folded position by lifting the sleeve into the upright position and then unfolding the sleeve following the same movement as for folding, but in the reverse direction.

When the sleeve 14 is folded down on the base 12, when the container 10 is not in use, it occupies a minimum volume and the lid 16 can then be placed on the sleeve 14 folded down on the base, so that several containers 10 thus arranged can be stacked for storage (FIG. 2).

It should be noted that when the sleeve 14 is folded down, the strap parts engaged in the openings will deform slightly, these small deformations being absorbed by elongation of the straps.

Figure 4:
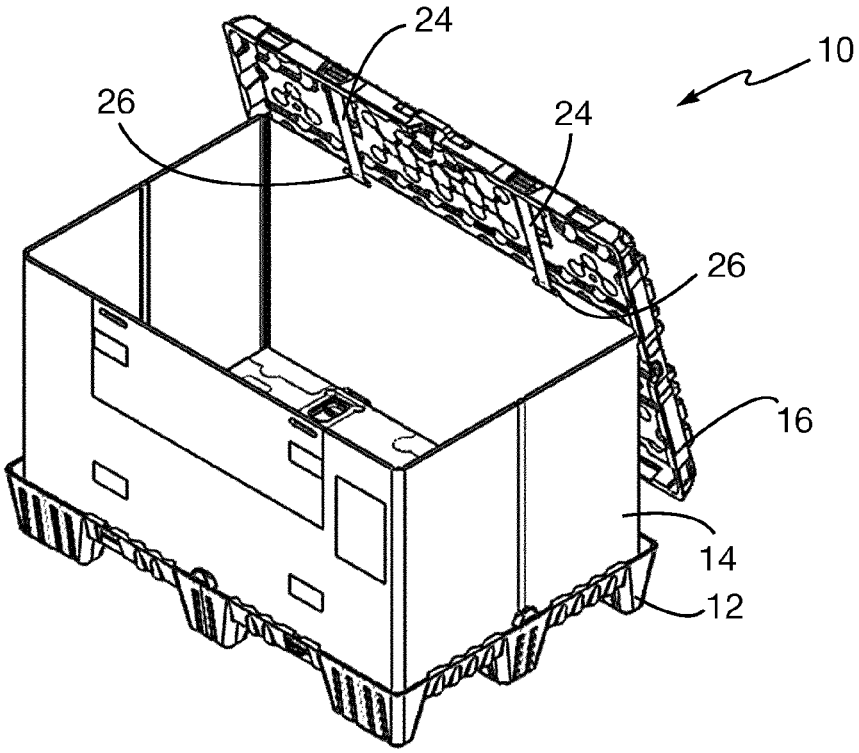

FIGS. 4 and 5 display an improvement provided by the invention.

The container 10 comprises at least one band 24 made of a flexible material that is fixed to the lid 16 at least two distant points, and that passes through an orifice 26 in at least one of the panels 18. The lid is thus connected to the sleeve 14 and can be guided by the band when the container is opened by sliding the band 24 in the orifice 26.

In the example shown, the lid 16 is provided with two bands 24, that are approximately parallel.

The bands 24 can be straps. They can be made of fabric, preferably elastic.

In one particular example embodiment, the bands are made of 40 mm wide Sanglatex® extra 7. This is a woven elastic material made of natural gum and coated with latex. The material preferably has an elongation ratio of 100%.

Each band 24 is arranged parallel to the plane of the lid. The bands are arranged symmetrically with each other about a vertical median plane of the container.

Each band 24 passes through an orifice 26 in the rear panel 18*b*. The orifices are at a distance from each other and from the lateral panels 18*c*. They are located at a distance from the top edge of the panel 18*b*, and are at approximately the same height and therefore approximately in the same horizontal plane.

In the example shown, the shape of each orifice 26 is elongated in a direction approximately parallel to the plane of the lid or the base, and therefore horizontal.

Each of the orifices 26 can be provided with an eyelet through which the band 24 passes, protecting the orifice 26 and facilitating passage of the band through the orifice.

Each band 24 comprises a first longitudinal end, in the case the front, fixed to a front edge of the lid 16 or slightly set back from this edge, and a second opposite longitudinal end, in this case the back, fixed to a back edge of the lid or slightly set back from this edge. The attachment of the ends of the bands to the lid may be of the removable type. In other words, the bands may be fixed permanently to the lid or they may be connected removably and therefore temporarily to the lid.

FIGS. 9 to 13*c* show an example embodiment of means of attachment of the bands to the lid, that in this case are retaining means designed to cooperate with the periphery of the lid.

The lid 16 in FIGS. 9 and 10 comprises assembly slits 28 for the bands around its periphery, and particularly their attachment/retaining means. The front edge of the lid comprises two slits 28 and the back edge of the lid comprises two other slits (not visible). The shape of each slit 28 is elongated in a direction approximately parallel to the plane of the lid, therefore horizontal.

Figure 11:
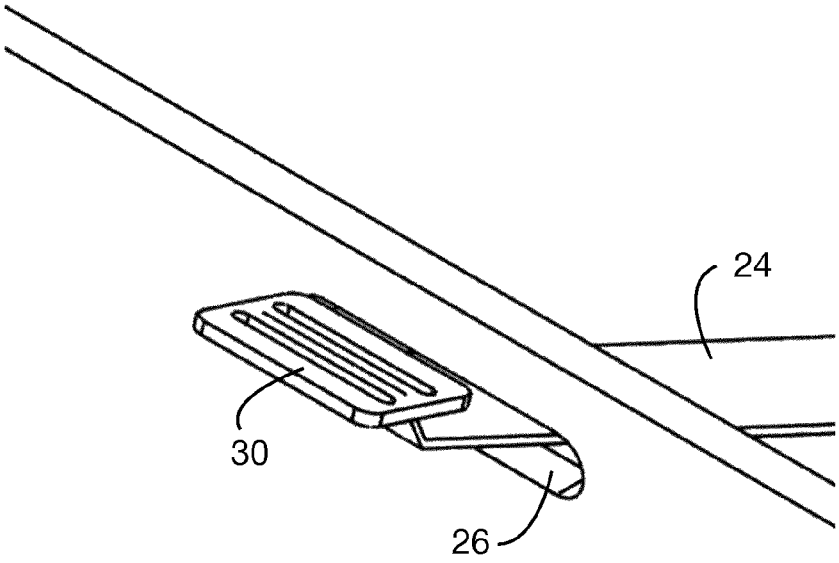
FIGS. 11 and 12 are schematic perspective views of bands made of flexible material for the container in FIG. 1, and show one example embodiment of means of fastening/retaining these bands.
Figure 12:
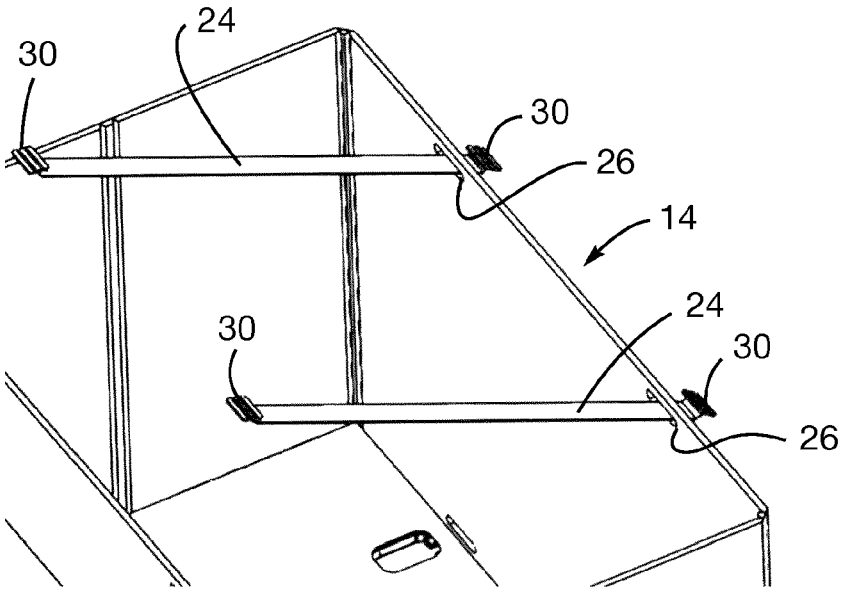

FIGS. 11 and 12 show attachment/retaining means provided at the ends of the bands. Each band end is fitted with a plate 30 or a loop that can be fixed to the end of the band by sewing. The plate can be metallic or plastic. It has an approximately parallelepiped shape with a thickness less than the width of a slit 28 (see FIG. 11) and a length less than the length of the slit (see also FIG. 11). The plate 30 is inserted through the slit as illustrated in FIGS. 13*a* and 13*b*, the plate being positioned approximately parallel to the plane of the lid (horizontally) so that it can be inserted through the slit 28. The plate is then pivoted so that it is oriented approximately perpendicular to the plane of the lid (vertically) and can bear on the peripheral edge of the slit (FIG. 13*c*). The width of the plate is larger than the width of the slit and therefore there is no risk that it could pass through the slit when it bears on the periphery of the slit. The elasticity of the band can be used to hold the plate in contact with the periphery of the slit. The band is then preferably slightly tensioned once it is mounted on the lid and the sleeve.

Once the first ends of the two bands are installed in this way in the slits 28 of one of the edges (front or back) of the lid 16, the opposite ends of the bands are inserted in the same way through the orifices 26 in the panel 18*b* of the sleeve, as shown on FIGS. 11 and 12. These opposite ends are then inserted as described above through the slits in the other edge (front or back) of the lid. In the mounted position, the plates 30 of the bands bear on the periphery of the lid, and the bands are more or less tensioned and pass through the orifices 26 in the sleeve 14. The connection of the lid to the sleeve through the bands 24 is then complete and the container can be used.

For disassembly or maintenance of the container, it is sufficient for example to apply a tension force on one of the plates 30 of each band towards the outside of the container and to pivot it to bring it back into the horizontal position approximately parallel to the plane of the lid so as to pass it through the slit in the lid.

Figure 14:
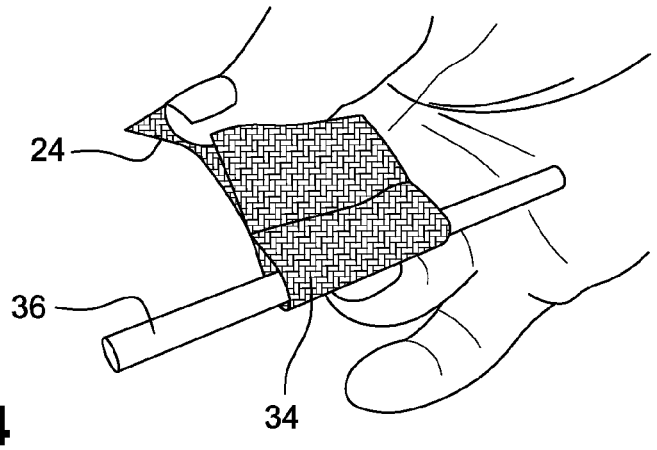
FIGS. 14 to 16 are schematic views showing a variant embodiment of the attachment/retention means of the bands made of material for the container according to the invention.
Figure 15:
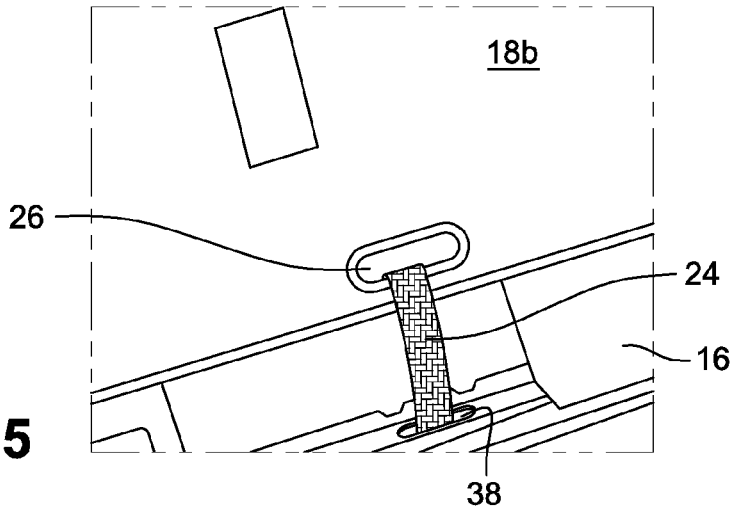
Figure 16:
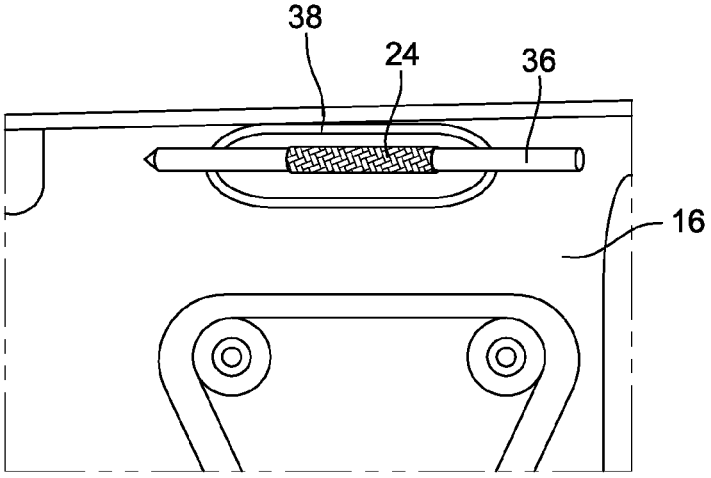

FIGS. 14 to 16 represent a variant embodiment of the attachment/retaining means. In this case, each end of the bands is fitted with a loop 34 and a rigid rod 36 that fits into the loop and projects beyond the ends of the loop (FIG. 14). The band is connected to the lid by inserting the end rod 36 of the band into a complementary slit 38 formed in the bottom of the above-mentioned groove of the lid (FIG. 15) and rotating or displacing this rod 36 relative to the slit 38, on the lid (FIG. 16), so as to solidarise the rod 36 to the lid by hooking it.

The band may have a determined length, slightly shorter than the distance between opposite grooves on the edges of opposite sides, such that as it is fitted with its connection to the lid (at the grooves) through its ends, it is slightly tensioned to hold the sleeve 14 rigidly attached to the lid 16 while providing a margin for movement of the band on the lid.

Naturally, it is possible to fit an attachment device on the connection end of the band to the lid that can be used to adjust the tightness of the band to the lid, such as a ratchet loop device tightened by pulling on the end of the band (not shown). Other means are available to a person skilled in the art.

In this case, the lid 16 comprises hooking or stop means 42 configured to cooperate with the base in order to retain the lid in a first open rest position, shown in FIGS. 6 and 7. The technology like that described in document EP-A1-2 868 592 can be used. In this first open rest position, the lid can extend over almost its entire height behind the panel 18*b*, approximately parallel to this panel or slightly inclined from it.

FIG. 8 represents a variant embodiment of the invention in which the container 10' comprises all the characteristics of the container 10 described above and also includes means of holding the lid in a second open rest position as illustrated in FIG. 8.

To achieve this, in the example shown, the bands include hooking or stop means 40 configured to cooperate with the peripheral edges of the orifices 26 so as to retain the lid in the second open rest position. In this second open rest position, the lid extends behind the back panel 18*b*, over only part of its height. The part of the lid 16 that extends above the top edge of the panel 18*b* can define a front bounce surface for articles in an installation for automatic loading of articles into the container.

The invention claimed is:

1. A container, comprising:

a base;

a folding sleeve;

a lid;

said folding sleeve comprising several panels and being able to be folded and laid out on said base such that the several panels extend approximately parallel to said base, and to be unfolded and placed on said base such that the several panels extend approximately perpendicular to said base, bearing on said base through lower edges of said several panels, said lid being capable of bearing on top edges of said several panels when said sleeve is unfolded and placed on the base; and at least one band of flexible material that is fixed to the lid at at least two points, and that passes through an orifice formed in at least one of said several panels, said lid being capable of being guided by said at least one band when the container is opened, by sliding of the band in said orifice over at least part of a length of the band between said two points, the band comprising a first longitudinal end fixed to a front downward-extending ledge of the lid or retained to said front downward-extending ledge, and a second opposite longitudinal end fixed to a back downward-extending ledge of the lid or retained to said back downward-extending ledge, the said first and second ends of the band being removable.

2. The container according to claim 1, wherein said at least one band is a strap.

3. The container according to claim 1, wherein said at least one band is made of fabric and has elastic properties.

4. The container according to claim 1, wherein the container comprises at least two bands of flexible material, including the at least one band of flexible material.

5. The container according to claim 4, wherein said at least two bands are approximately parallel.

6. The container according to claim 4, in which said at least two bands pass through a plurality of orifices in a same panel of the several panels.

7. The container according to claim 6, wherein a shape of each orifice of the plurality of orifices is elongated in a direction parallel to a plane of the lid or a plane of the base.

8. The container according to claim 6, wherein each orifice of the plurality of orifices is located at a same distance from a top edge of the panel in which it is formed.

9. The container according to claim 1, wherein the at least one band comprises hooking or stop means configured to cooperate with a peripheral edge of said orifice in order to retain said lid in an open rest position in which the lid extends at least partially behind one panel of the several panels.

10. The container according to claim 1, wherein said lid comprises hooking or stop means configured to cooperate with said base in order to retain said lid in an open rest position in which the lid extends at least partially behind one panel of the several panels.

11. The container according to claim 9, wherein the hooking or stop means are configured to engage the peripheral edge of said orifice.

12. The container according to claim 9, wherein the hooking or stop means are configured to cooperate with the peripheral edge of said orifice such that in the open rest position, a portion of the lid extends above the top edge of the panel.

13. The container according to claim 12, wherein in the open rest position, the portion of the lid that extends above the top edge of the panel defines a front bounce surface configured to assist loading of articles into the container.

* * * * *